US009347151B2

(12) United States Patent
Malina et al.

(10) Patent No.: US 9,347,151 B2
(45) Date of Patent: May 24, 2016

(54) COMPACTION DEVICE FOR A SPINNING MACHINE

(75) Inventors: Ludek Malina, Kloten (CH); Robert Nägeli, Kleinandelfingen (CH); Gabriel Schneider, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 185 days.

(21) Appl. No.: 14/234,800

(22) PCT Filed: Jun. 29, 2012

(86) PCT No.: PCT/CH2012/000143

§ 371 (c)(1),
(2), (4) Date: Jan. 24, 2014

(87) PCT Pub. No.: WO2013/013329

PCT Pub. Date: Jan. 31, 2013

(65) Prior Publication Data

US 2014/0157551 A1 Jun. 12, 2014

(30) Foreign Application Priority Data

Jul. 25, 2011 (CH) ..... 1242/11

(51) Int. Cl.

| | |
|---|---|
| ***D01H 5/72*** | (2006.01) |
| ***D01H 1/02*** | (2006.01) |
| ***D01H 5/74*** | (2006.01) |

(52) U.S. Cl.

CPC ..... *D01H 5/72* (2013.01); *D01H 1/025* (2013.01); *D01H 5/74* (2013.01)

(58) Field of Classification Search

CPC ..... D01H 1/025; D01H 5/50; D01H 5/505; D01H 5/56; D01H 5/72; D01H 5/74; D01H 5/86

USPC ..... 57/315

See application file for complete search history.

(56) References Cited

U.S. PATENT DOCUMENTS

| | | | | | |
|---|---|---|---|---|---|
| 5,600,872 | A * | 2/1997 | Artzt | D01H 1/025 | 19/150 |
| 6,032,451 | A * | 3/2000 | Dinkelmann | D01H 1/025 | 57/315 |
| 6,131,382 | A * | 10/2000 | Dinkelmann | D01H 1/025 | 57/315 |
| 6,131,383 | A * | 10/2000 | Dinkelmann | D01H 1/025 | 57/315 |
| 6,318,060 | B1 * | 11/2001 | Dinkelmann | D01H 1/025 | 19/244 |
| 6,324,825 | B2 * | 12/2001 | Dinkelmann | D01H 1/025 | 19/150 |
| 6,336,256 | B1 * | 1/2002 | Naf | D01G 15/64 | 19/157 |

(Continued)

FOREIGN PATENT DOCUMENTS

DE 197 26 694 A1 4/1998

OTHER PUBLICATIONS

PCT Search Report, Oct. 5, 2012.

*Primary Examiner* — Shaun R Hurley
(74) *Attorney, Agent, or Firm* — Dority & Manning, P.A.

(57) ABSTRACT

A compacting unit for compacting a fiber composite supplied by a drafting unit of a spinning machine has a beam on which at least one suction drum equipped with a suction zone is rotatably mounted on an axle. A clamping roller mounted on the beam is in contact with the suction drum to form a clamping line at the end of the suction zone under the action of a pressure element mounted on the beam. The clamping roller is mounted so it is rotationally movable on a pressure arm that is equipped with a spring element and is mounted on the beam so it can pivot over a pivot axis.

13 Claims, 3 Drawing Sheets

(56) References Cited

U.S. PATENT DOCUMENTS 7,451,526 B2 * 11/2008 Duda ..... D01G 15/46 19/240
2001/0020357 A1 * 9/2001 Dinkelmann ..... D01H 1/025 57/315
2001/0054280 A1 * 12/2001 Camozzi ..... D01H 5/26 57/315
2012/0297748 A1 * 11/2012 Malina ..... D01H 5/82 57/315
2013/0239369 A1 9/2013 Schneider et al.
2015/0027098 A1 * 1/2015 Nageli ..... D01H 5/72 57/315

* cited by examiner

COMPACTION DEVICE FOR A SPINNING MACHINE

FIELD OF THE INVENTION

The invention relates to a compacting unit for compacting a fiber strand supplied by a drafting unit of a spinning machine, wherein the compacting unit has a beam on which at least one suction drum equipped with a suction zone is mounted to rotate on an axle and with which a clamping roller mounted on the beam is in contact under the action of a pressure element mounted on the beam to form a clamping line at the end of the suction zone.

BACKGROUND

In practice, a variety of embodiments have already become known, wherein a compacting device is arranged downstream for compacting the fiber material (fiber strand) delivered from a drafting unit. The compacted fiber material is sent to a twist-producing device after passing through a clamping point downstream from such a compacting device. Such a twist-producing device consists of a rotor running on a ring in the case of a ring-spinning machine, for example, wherein the yarn thus produced is wound onto a peripheral sleeve. Rotating perforated suction drums or rotating belts provided with perforations are essentially used as the compacting devices.

Compacting devices which can also be added on subsequently to drafting units are also known.

One such compacting device was proposed in the unpublished CH patent application CH 01992/10 of Nov. 26, 2010, in which a retrofittable compacting unit is proposed as a pivotable compact component which is easily installed on the spinning machine. Due to the proposed pivotable mounting, it can easily be transferred from its installed position into an operating position at the outlet of the drafting unit. It can also be converted easily and without the use of special tools from the operating position into a non-operating position. The drive of the compacting roller shown here is accomplished by means of friction and special drive means from the driven bottom roller of the starting roller pair of the drafting unit. The compacting roller is pressed against the bottom roller of the starting roller pair by means of pressure elements provided on the machine frame in particular. A clamping roller presses against the respective suction drum by means of a spring element attached to a beam of the module to create a clamping site for the compacted fiber material downstream from the suction zone before it is sent to a downstream twist-producing device.

The mounting of the clamping roller as proposed here requires a special tool and is not flexible. In other words, to release the clamping site between the suction drum and the clamping roller, it is first necessary to loosen the screw mounting. Only then can the clamping roller be removed from its clamping position.

On the basis of the known approaches, the problem that now arises is to propose a device for mounting a clamping roller which can be installed and dismantled easily and rapidly without requiring any special tools.

SUMMARY OF THE INVENTION

Additional objects and advantages of the invention will be set forth in part in the following description, or may be obvious from the description, or may be learned through practice of the invention.

An object is achieved in that it is proposed that the clamping roller be mounted on an axle to rotate on a pressure arm, which is equipped with a spring element and is pivotably mounted on the beam by means of a pivot axis. Due to the pivotable arrangement, the clamping roller can easily be pivoted out of the clamping position and into a non-operating position. It is also simple to pivot it back into an operating position out of the non-operating position, while the compressive force of the spring element which was set previously remains constant. In addition, it is proposed that the spring element be mounted between the pivot axis of the pressure arm and the axis of rotation of the clamping roller. This achieves a compact design of the pressure arm.

To hold the clamping roller securely in its working position on the respective suction drum, it is further proposed that a stop be provided on the beam, protruding into the area of movement of the pressure arm in order to hold the pressure arm in a top dead center position, where the axle of the clamping roller is situated next to a plane running through the axis of the suction drum and the pivot axis of the pressure arm.

For use of the compacting unit on a twin drafting mechanism such as that generally used, it is proposed that the compacting unit be provided with two suction drums arranged coaxially opposite one another, a clamping roller being assigned to each suction drum, wherein the clamping rollers are mounted rotatably on a shared pressure arm on the same axle. This yields a simplified and compact structural unit for use on a twin drafting mechanism, wherein only one beam is required for both suction drums and one pressure arm for both clamping rollers.

For quick and simple fastening of the clamping rollers on the pressure arm, it is proposed that the pressure arm be provided with an open U-shaped receptacle for the axle of the clamping rollers facing in the direction of the suction drums. It is thus possible to quickly transfer the axle of the clamping roller through the opening of the receptacle into its working position inside the receptacle without requiring any special tools.

In addition, it is proposed that the length of the receptacle as seen in the longitudinal direction of the pressure arm is greater than the diameter of the axle of the clamping rollers guided in the receptacle and the at least one element which is acted on by the spring element protrudes into the receptacle within the range of movement of the axle in the longitudinal direction of the receptacle. In this way, the displacement of the axle of the clamping roller in the longitudinal direction of the receptacle is made possible while at the same time it is loaded with a compressive force by the spring element by means of the element protruding into the receptacle. This yields a very flexible mounting of the clamping rollers. It is also proposed that the inside clearance of the receptacle be smaller in the area of its opening than the diameter of the axle of the clamping rollers guided in the receptacle. It is thus possible to keep the axle of the clamping rollers, which is mounted in the receptacle, in the receptacle even if the clamping roller in the condition in which it is pivoted outward no longer receives a counterpressure acting through the suction drum. In other words, the compressive force, which is still acting on the axle of the clamping roller by way of the spring-loaded element protruding into the receptacle, is smaller than the force which is sufficient to force the axle out of the constricted opening in the receptacle. Thus, the pre-assembly of the pressure arm with the clamping roller is also made possible without causing the clamping rollers to fall out of the receptacle of the pressure arm.

Preferably, at least the receptacle is manufactured from an elastic material, for example, a plastic. By using the elastic material, it is possible to insert the axle of the clamping roller through the constricted opening into the receptacle of the pressure arm by applying only a low force. Due to the elasticity of the material (e.g., plastic), the material returns to its original shape in the area of the opening and thus lock the axle in the installed position in the receptacle.

In order for the axle of the clamping rollers to be held securely in the installed position even when it is in the front region of the opening, it is proposed that the total of the maximum protruding mass with which the element can protrude into the receptacle under a spring load and the diameter of the axle of the clamping rollers in the receptacle should be larger than the length of the receptacle between an inner end limit and the region of the opening that has a reduced inside clearance. However, the compressive force that is still acting in the front position is smaller than the force required to push the axle of the clamping rollers over the constricted position of the opening and out of the receptacle. To transfer the pressure arm into its pivoted position easily and without the use of a special tool, it is proposed that the pressure arm be provided with an axle arranged across its longitudinal direction, so that the axle protrudes beyond the width of the pressure arm and the beam has two oppositely positioned guides by means of which the pressure arm is guided when transferred to its pivoted position. In addition, it is proposed that elements that are mounted with spring resilience and lock the axle of the pressure arm in its pivoted position on reaching this position should be mounted in the area of the guides. The pressure arm is therefore securely held in its pivotable position. For dismantling it from this position, the spring-mounted elements can be transferred without the use of a special tool into a position to achieve a release of the axle of the pressure arm. Next, this can be dismantled easily by means of the guides.

The pressure arm may preferably be manufactured of plastic and the spring element may be accommodated in an encapsulated space of the pressure arm. This yields a compact and self-contained module in which the spring element is protected from soiling.

Additional advantages of the invention are illustrated in the figures and described in greater detail in the following exemplary embodiments.

DETAILED DESCRIPTION

Figure 1:
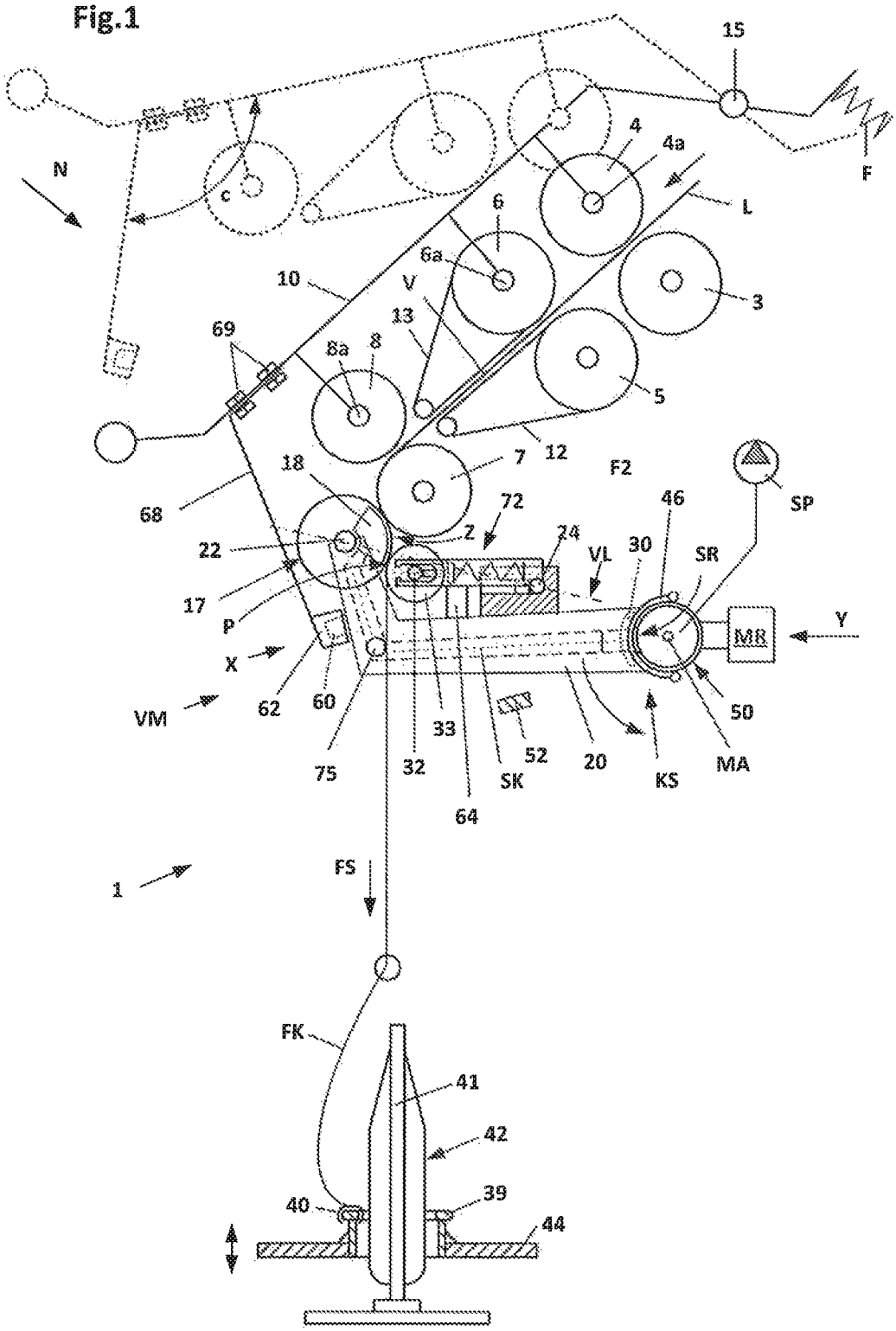
FIG. 1 is a schematic side view of a drafting unit of a compacting unit with an add-on module which is in the locked position.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic side view of a spinning station 1 of a spinning machine (ring spinning machine) having a drafting unit 2 that is equipped with an input roller pair 3, 4, a middle roller pair 5, 6 and an output roller pair 7, 8. A belt 12, 13, which is held in the position shown here around a cage (which is not shown in greater detail) is guided around the middle rollers 5, 6. The upper rollers 4, 6, 8 of the aforementioned roller pairs are embodied as pressure rollers which are mounted to be rotationally movable by means of the axles 4*a*, 6*a*, 8*a* on a pivotably mounted pressure lever 10. The pressure lever 10 is mounted to be pivotable about an axis 15 and is acted upon by a spring element F, as shown schematically here. This spring element may also be a pneumatic tube. By means of the spring load that is illustrated schematically, the rollers 4, 6, 8 are pressed against the bottom rollers 3, 5, 7 of the roller pairs to form a clamping site for the fiber material. The rollers 3, 5, 7 are connected to a drive (not shown). Individual drives as well as other drive forms (gear wheels, toothed belts, etc.) may also be used. The pressure rollers 4, 6, 8 and/or the belt 13 are driven via the belt 12 by friction over the driven bottom rollers 3, 5, 7. The circumferential speed of the driven roller 5 is somewhat higher than the circumferential speed of the driven roller 3, so that the proper material supplied to the drafting unit 2 in the form of a sliver L between the input roller pair 3, 4 and the middle roller pair 5, 6 is subjected to a preliminary drafting. The main drafting of the fiber material V occurs between the middle roller pair 5, 6 and the output roller pair 7, 8, wherein the output roller 7 has a much higher circumferential speed than the middle roller 5.

Figure 1A:
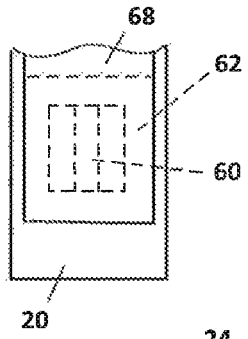
FIG. 1*a* is an enlarged view X of the coupling site from FIG. 1.
Figure 1B:
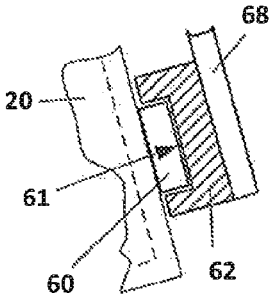
FIG. 1*b* is a side view ac to FIG. 1*a;*
Figure 1C:
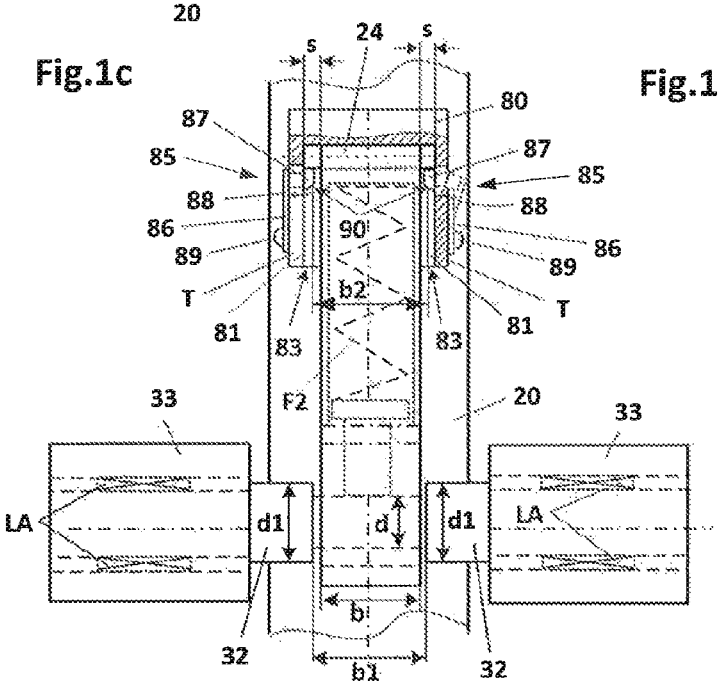
FIG. 1*c* is an enlarged top view of the pressure arm according to FIG. 1.
Figure 1D:
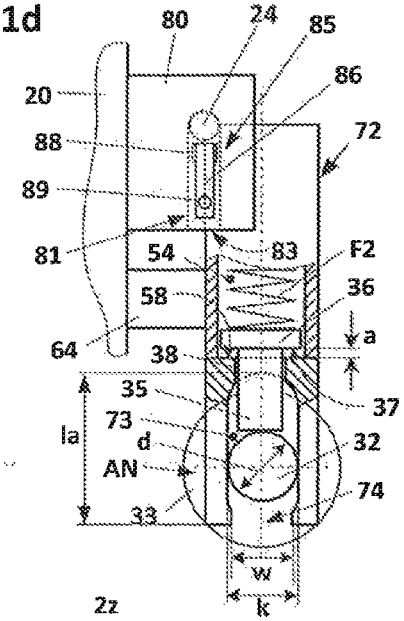
FIG. 1*d* is a side view M according to FIG. 1*c;*
Figure 1E:
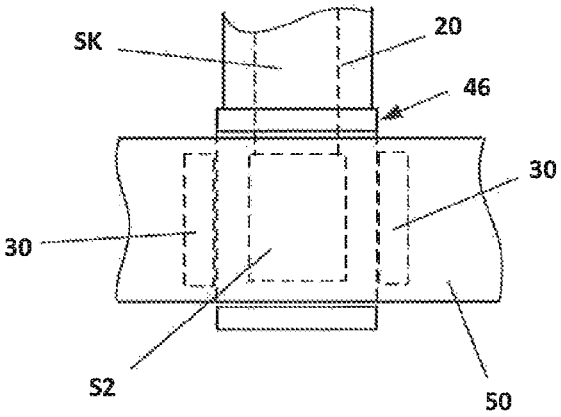
FIG. 1*e* is an enlarged view Y according to FIG. 1 with side guides for lateral fixation for the beam of the compacting unit.
Figure 1F:
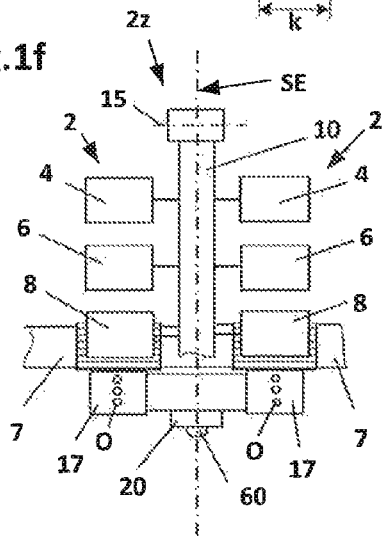
FIG. 1*f* is a reduced to view N according to FIG. 1.

As also indicated by FIG. 1*f* (view N according to FIG. 1), a pressure lever 10 is arranged between two neighboring drafting units 2 (twin drafting set 2*z*). Since these are the same elements of the neighboring drafting units and/or compacting devices, the same reference numerals are used for these parts.

The drawn fiber material V discharged from the output roller pair 7, 8 is deflected downward and enters the region of a suction zone Z of a downstream suction drum 17. The respective suction drum 17 is provided with perforations, i.e., openings "O", (FIG. 1*f*) running on its circumference. Within the suction drum 17 that is rotatably mounted, there is a suction insert 18 in a stationary melt, attached to a beam 20 of a compacting unit VM. Embodiments and arrangements of the suction insert are disclosed in the CH patent application CH 01992/10 of Nov. 26, 2010. Likewise, drive elements that are connected to the respective suction drum 17 and assume a friction locking connection in the operational position with the bottom roller 7 of the output roller pair are also shown here. In any case, the respective suction drum 17, or drive means connected thereto, lies on the circumference of the driven roller 7 and is driven by it by means of friction.

The pressing force of the suction drum 17 on the bottom roller 7 is accomplished by means of a plate spring 68, which is attached to the pressure lever 10 by means of screws 69, as shown in the example in the FIG. 1. The angle "c" of the plate spring 68 in the position shown here with dotted lines in which it is pivoted upward becomes larger when the closed operating position shown with solid lines is assumed. Thus, the plate spring exerts a compressive force in the direction of the attachment 60, which is mounted on the beam 20 in the region of the web 62 of the spring, mounted on the end, so that the compacting unit is locked in this position. It is also possible to mount the attachment 60 directly in the region of the bearing site for the axle 22.

As can be seen from the enlarged views of FIG. 1*a* (view X according to FIG. 1) to FIG. 1*b*, a web 62 attached to the free end of the plate spring 68 assumes a form-fitting connection with the attachment 60 over the recess 61 therein or in the plate spring. Thus, the pressure lever 10 and the pressure cylinders 4, 6, 8 attached to the pressure lever are fixedly coupled to the beam 20 of the compacting unit VM by which these pressure rollers are positioned laterally with respect to the suction drum 17 and its clamping roller 33. In other words, the pressure lever 10 is also secured with respect to the machine frame MR across its pivot plane SE (FIG. 1*f*) indirectly via the compacting unit VM. Furthermore, due to this simultaneous locking of the drafting unit 2 and the compacting unit VM by means of only one pressure lever, it is ensured that in the engaged operating position of the pressure lever, the suction drums of the compacting unit are also in the operating position. This was not always ensured with previous approaches using independent locking.

The suction drum 17 and/or two suction drums 17 assigned to one twin drafting frame 2*z* (FIG. 1*f*) is/are rotatably mounted on the beam 20 of the compacting unit VM on a shaft 22 attached to the beam. A suction channel SK is provided within the beam 20, and is connected to the respective suction insert 18, as shown schematically in FIG. 1. The beam is provided with a U-shaped end piece 46 into which the suction channel SK opens with an opening S2 on the end of the beam facing the machine frame MR of the spinning machine. The opening S2 is opposite an opening SR in a suction tube 50, which is attached to the machine frame MR of the spinning machine, in the position shown here.

With a U-shaped end piece 46 mounted on the end of the beam 20, the beam is attached so it can pivot about the central axis MA of the suction tube and forms a coupling point KS. A clamping effect between the suction tube 50 and the end piece 46 is achieved by means of an end piece 46 designed with dimensions accordingly with respect to the dimensions of the suction tube 50, so that the beam 20 is held on the suction tube 50.

As indicated schematically in FIG. 1, guides 30 are attached to the suction tube 50 on both sides of the end piece 46, so that the end piece 46 and thus the compacting unit VM, are secured laterally in the direction of the central axis MA by means of these guides. This is also apparent from the enlarged diagram of FIG. 1*e* (view y according to FIG. 1). The pressure lever 10 is held in a fixed position with the pressure rollers 4, 6, 8 with respect to the machine frame by means of the coupling point 68, 60, 62 and by this lateral fixation of the compacting unit on the suction tube 50, and thus on the machine frame MR.

In a suction zone Z, the fibers protruding outward are bound in under the influence of a vacuum applied by means of a vacuum source SP and the fiber material is compressed. To do so, the respective suction drum is provided with openings "O" on its circumference which cooperate with suction slots (not shown) in the suction insert 18.

Following the suction zone Z, a clamping roller 33 rests on the respective suction drum 17 via a pressure load and forms a clamping line P together with the suction drum 17. The respective clamping roller 33 is rotatably supported on an axle 32 that is held in a guide slot 73 which is provided with an opening 74 in a U-shaped receptacle AN of a pressure arm 72. The axle 32 is displaceably supported within the guide slot 73 across its longitudinal axis with a length 1*a*. A tappet or ram 35 sits on the outside circumference of the axle 32 and is acted upon by a compression spring F2 that protrudes through an opening 38 into the guide slot. The opening 38 is mounted approximately centrally on the end of the guide slot 73 and opens into a cavity 54 that is essentially closed and in which the compression spring F2 is arranged. The spring is supported on the closed end of the cavity at one end and is supported on a head 36 of the ram 35 at the opposite end. The head 36 has a larger diameter than the inside clearance of the opening 38. This prevents the ram 35 from being able to slide through the opening 38 with its head 36. If there is no axle 32 within the guide slot, then the shoulder 37 of the head 36 comes to rest against the stop face 58 of the cavity 54 due to the suitable selected geometric relationships and the spring force available from the compression spring F2.

As shown in FIG. 1*c*, the clamping roller 33 is rotatably mounted over a bearing LA, which is shown schematically, on the axle 32 on both sides of the receptacle AN of the pressure arm 72. As already described, the clamping rollers 33 are driven by friction by suction drums 17 (not shown in this diagram). To hold the clamping rollers 33 in their position in the axial direction, the diameter dl of the axle 32 connected to the pressure arm 72 is selected to be larger than the diameter d with which the axle 32 moves within the guide slot 73 in the receptacle AN. The distance b1 between the enlarged diameters dl is somewhat larger than the width b of the receptacle AN of the pressure arm 72.

To hold the clamping roller 33 in their mounted positions within the guide slot 73 by means of their axles 32, a constriction with an inside width w which is smaller than the diameter d of the axle 32 and the inside width k of the guide slot 73 is provided in the area of the opening 74 of the guide slot 73. The dimension k of the guide slot is only slightly larger than the diameter d to permit displacement of the axle 32 within the guide slot. On mounting the clamping rollers on the pressure arm 72, the axle 32 is transferred by a slight pressure through the constriction of the opening 74 into the guide slot 73. Due to the use of an elastic material (e.g., plastic), the material yields laterally in the area of the opening 74 and returns to its original position after passing the axle 32. As soon as the axle 32 has passed the constriction in the area of the opening 74, the ram 35 already comes to rest against the circumference of the axle 32 and exerts a compressive force on the axle 32 in the direction of the opening 74 of the receptacle AN under the action of the compression spring F2. Between the shoulder 37 of the head 36 and the surface 58 there is now a distance a so that the spring force of the spring F2 is manifested and can exert a compressive force on the circumference of the axle 32 by way of the ram 35. However, this force is lower than the force required to push the axle 32 beyond the constriction with the width w out of the receptacle AN. Thus the axle 32 of the clamping rollers 33 is held in a stable position in the mounted state even if no opposing pressure is yet being generated by the suction drums with which they form a clamping site P during operation.

On the opposite end of the receptacle AN, an axle 24 that protrudes with a dimension s beyond the width b of the pressure arm 72 on both sides is attached to the opposite end of the receptacle AN. The pressure arm is held pivotably in a bearing element 80 by means of this axle 24 protruding beyond the pressure arm 72. The bearing element 80 has two webs T running parallel to one another at a distance b2 with pressure arm 72 arranged between them so it can execute a pivoting movement. The bearing element 80 is fixedly connected to the beam 20. To be able to transfer the pressure arm 72 by hand without using a special tool into the mounted position shown in FIG. 1*c* and FIG. 1*d*, a guide 81 is provided on each of webs T, said guide being in the form of a longitudinal groove and opposite one another. In mounting, the pressure arm 72 is inserted beyond the protruding ends of the axle 24 on each open end 83 of the guides 81 and transferred into the operating position shown in FIGS. 1*c* and 1*d* by overcoming the spring-loaded locks 85. The locks 85 are bolts 87 each of which protrudes through an opening 88 into the respective guide 81. The bolts are each mounted on one end of a spring rod 86 whose other end is attached via fastening means 89 to the webs T on the outside. To move the bolts 87 of the locks 85 into their pivot position (operating position) in a position outside of the guides (with dashed lines in the diagram in FIG. 1*c*) when transferring the axle 24 into its pivoted position (operating position), the bolts are provided with an inclined face 90 by means of which they are forced through the respective opening 88 out of the area of movement of the axle, i.e., out of the guide 81 against the spring action of the spring rod 86 through the axle 24 moving in the respective guide 81. After the axle 24 has passed the location of the locks 85 (where their bolts 87 protrude into the respective opening 88) during the transfer into the operating position, the bolts 87 are moved back into the region of the guides 81 under the spring action of the spring rods 86. Thus, the reverse movement for the axle 24 is blocked and the axle is secured in its pivoted position. Since the bolts 87 have a straight surface (running approximately parallel to the lateral surface of the axle 24) on the opposite side of the inclined surface 90, dismantling of the pressure arm can be accomplished only with additional manipulations or aids. This should prevent the pressure arm from being unintentionally released from the pivot position. For dismantling of the pressure arm, the locks are forced by hand or with additional aids out of their respective openings 88 so that the axle 24 can pass by the locked position. After passing this position, the pressure arm can be removed through the guides 81 with no problem. With the proposed inventive design of the pressure arm of the clamping rollers, a compact and closed design is obtained which is protected from soiling on the one hand while on the other hand being easy to install and dismantle without requiring any special tools.

The clamping line P between the suction drum 17 and the clamping roller 33 resting on it under pressure at the same time forms a so-called "rotational locking gap" from which the fiber material is conveyed in the direction of conveyance FS in the form of a compressed yarn FK while imparting a rotation to a ring spinning device, which is shown schematically here, and which is provided with a ring 39 and a rotor 40 such that the yarn 41 is wound onto a sleeve 42 to form a bobbin 42 (spool). A thread guide 43 is arranged between the clamping line P and the rotor 40. The ring 39 is attached to a ring frame 44 which executes an up-and-down motion during the spinning process.

To be able to remove by suction the yarn FK which continues to be supplied beyond the clamping point P in the event of a thread breakage between the clamping line P and the bobbin 42, a suction tube 75 equipped with an opening (not shown) is attached on both sides of the beam 20. The suction tube opens into the suction channel SK of the beam 20.

Figure 2:
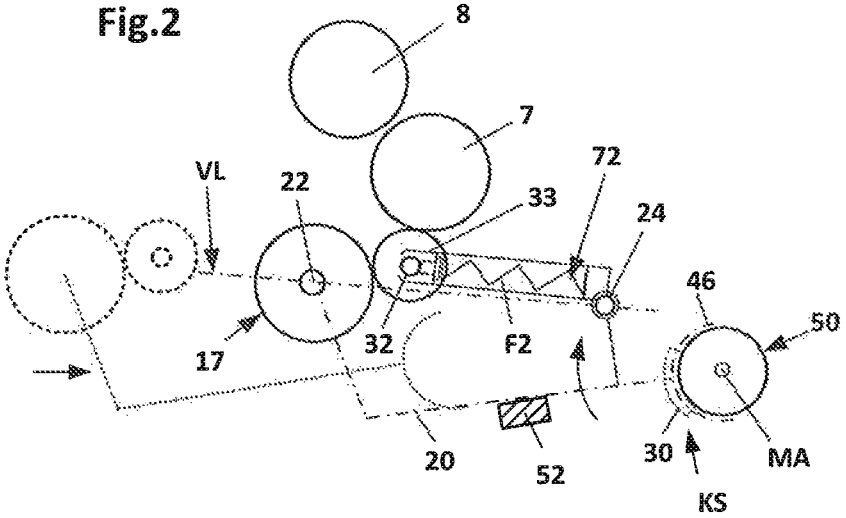
FIG. 2 is a schematic partial view of the compacting unit in a non-operating position with a clamping roller above a dead center position.
Figure 3:
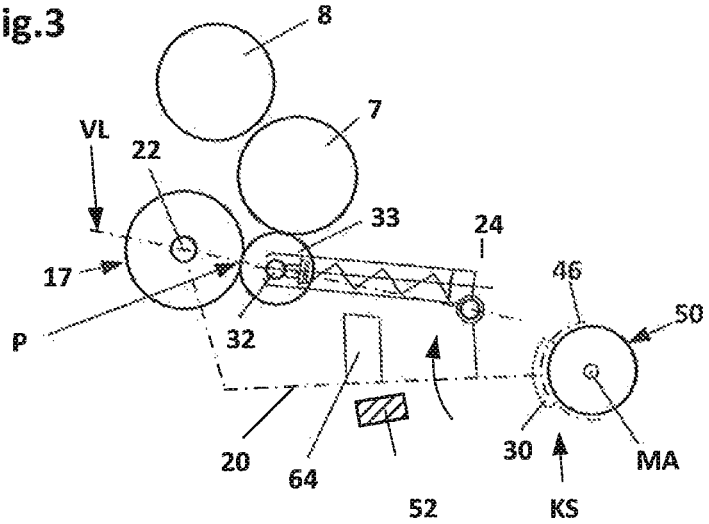
FIG. 3 is a schematic partial view according to FIG. 2 with a roller in the dead center position.
Figure 4:
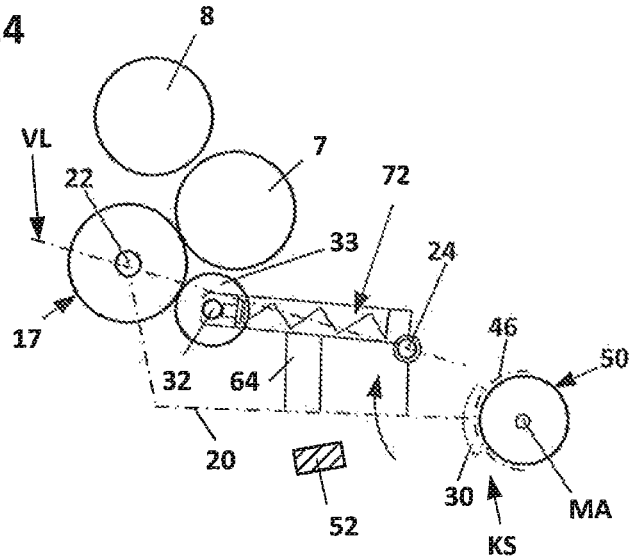
FIG. 4 is a schematic partial view according to FIG. 2 with a roller below the dead center position.

In the exemplary embodiments in FIG. 2 through FIG. 4, the transfer of the suction drums 17 from a non-operating position into an operating is shown. The beam 20 is indicated only schematically with a dash-dot line.

As shown in FIG. 2, the beam 20 is transferred from a position shown with dashed lines into a first mounted non-operating position via the guide 52 (which at the same time forms a stop for the lower pivoted position of the compacting unit VM). In shifting the beam in the direction of the suction tube 50, the end piece 46 is pushed by hand onto the suction tube 50 in the area of the coupling site KS until it sits on the suction tube and is clamped there. The end piece 46 is pushed between the lateral guides 30. Then the beam 20 and/or the entire compacting unit VM can be pivoted about the central axis MA of the suction tube 50 over the end piece 46 in the direction of the output roller pair 7, 8 of the drafting unit 2.

As shown in FIG. 2, in pivoting (see direction of arrow) the clamping roller 33 comes to rest against the bottom roller 7 of the output roller pair 7, 8 of the drafting unit 2. With further pivoting, the clamping roller 33 reaches the top dead center position shown in FIG. 3 in which the axis of rotation 32 lies precisely in the plan VL, which runs through the axle 22 of the suction drum 17 and the pivot axis 24 of the pressure arm 72. The clamping roller 33 is always held in contact with the outside circumference of the suction drum 17 by means of the spring F2 arranged in the pressure arm 72. With further manual pivoting of the compacting unit VM in the direction of the arrow, the position diagrammed schematically in FIG. 4 is reached. The suction drum 17 or the driving means connected to it then comes in contact with the bottom roller 7 so that a drive connection is established by friction between the driven roller 7 and the suction drum 17. At the same time the clamping roller 33 is pivoted under the action of the bottom roller 7 and the spring F2 into the top dead center position which is diagrammed in FIG. 4. In other words, the axle 32 of the clamping roller 33 is now below the plane VL in which the axle 22 of the suction drum 17 and the pivot axis 24 of the pressure arm 72 is situated. To limit the pivoting movement of the pressure arm 72 and thus the clamping roller 33 in the downward direction, a stop 64 on which the pressure arm 72 comes to rest is mounted on the beam 20 (FIG. 4). In the operating position shown in FIG. 4, the clamping roller 33 forms a clamping point P with the suction drum 17 under the action of the spring F2 and is driven by the suction drum by means of friction. After reaching the operating position shown in FIG. 4 (as already described), the pressure lever 10 is closed so that the compacting unit VM is locked with the drafting unit 2 by means of the web 62 mounted on the plate spring 68 and the attachment 60 provided on the beam 20.

The compacting unit is dismantled in the opposite direction. The return of the clamping roller 33 to the position shown in FIG. 2 after dismantling may be accomplished manually.

Modifications and variations can be made to the embodiments illustrated or described herein without departing from the scope and spirit of the invention as set forth in the appended claims.

The invention claimed is:

1. A compacting unit for compacting a fiber composite supplied by a drafting unit of a spinning machine, the compacting unit comprising:

a beam;

at least one suction drum having a suction zone, the suction drum rotatably mounted on the beam via an axle;

a clamping roller mounted on the beam so as to form a clamping line with the suction drum at an end of the suction zone;

the clamping roller mounted via an axle so as to be rotationally movable on a pressure arm, the pressure arm pivotally mounted on the beam at a pivot axis; and a spring element mounted on the pressure arm to press the clamping roller against the suction drum at the clamping line.

2. The compacting unit as in claim 1, wherein the spring element is mounted between a pivot axis of the pressure arm and an axis of rotation of the clamping roller.

3. The compacting unit as in claim 1, further comprising a stop disposed on the beam so as to contact and hold the pressure arm in a pivoted center position in which the axle of the clamping roller lies adjacent to a plane through the axle of the suction drum and the pivot axis of the pressure arm in an operational position of the compacting unit on a spinning machine.

4. The compacting unit as in claim 1, comprising two of the suction drums coaxially arranged with respective clamping rollers and rotatably mounted on a common pressure arm along a common rotational axle.

5. The compacting unit as in claim 4, wherein the pressure arm comprises a U-shaped receptacle oriented towards the suction drums for receipt of the clamping roller rotational axle.

6. The compacting unit as in claim 5, wherein the receptacle has a length in a longitudinal direction of the pressure arm that is greater than a diameter of the clamping roller rotational axle, and further comprising a ram element that extends into the receptacle and is acted upon by the spring element at a first end and engages the clamping roller rotational axle at an opposite end.

7. The compacting unit as in claim 6, wherein the receptacle has an opening with an inside clearance dimension that is smaller than a diameter of the clamping roller rotational axle that is received within the receptacle.

8. The compacting unit as in claim 7, wherein the receptacle is made of an elastic material that allows insertion of the clamping roller rotational axle through the opening of the receptacle.

9. The compacting unit as in claim 7, wherein a sum of a length of the ram element extending into the receptacle under load of the spring element and the diameter of the clamping roller rotational axle received in the receptacle is larger than an internal longitudinal length of the receptacle from the opening to an internal end of the receptacle.

10. The compacting unit as in claim 1, wherein the pressure arm comprises an axle at the pivot axis that extends beyond each side of the pressure arm and is received in opposing guides on the beam by which the pressure arm is guided when pivoted.

11. The compacting unit as in claim 10, further comprising elastic locking elements mounted at the guides that lock the pressure arm axle in a pivoted position.

12. The compacting unit as in claim 11, wherein the locking elements are in an elastic mount and movable to a position to release the pressure arm axle from the guides.

13. The compacting unit as in claim 10, wherein the pressure arm is made of a plastic material and the spring element is disposed within an encapsulated space of the pressure arm.

* * * * *